US008554120B2

(12) United States Patent
Nakao et al.

(10) Patent No.: US 8,554,120 B2
(45) Date of Patent: Oct. 8, 2013

(54) IMAGE FORMING APPARATUS AND COMPUTER READABLE MEDIUM STORING PROGRAM

(75) Inventors: Yoshihisa Nakao, Ebina (JP); Yoshihiro Enomoto, Ebina (JP); Katsunori Kikuchihara, Ebina (JP); Katsuya Takenouchi, Ebina (JP); Yoshiya Mashimo, Ebina (JP); Hiroyuki Koide, Ebina (JP); Masatoshi Yamada, Ebina (JP); Kazuyuki Yagata, Ebina (JP); Kiyotoshi Kaneyama, Ebina (JP); Kenji Suzuki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 212 days.

(21) Appl. No.: 13/088,933

(22) Filed: Apr. 18, 2011

(65) Prior Publication Data

US 2012/0114395 A1 May 10, 2012

(30) Foreign Application Priority Data

Nov. 5, 2010 (JP) ..... 2010-248725

(51) Int. Cl.
*G03G 15/01* (2006.01)

(52) U.S. Cl.
USPC ..... 399/301

(58) Field of Classification Search
USPC ..... 399/38, 40, 301, 302, 395; 217/261, 217/265.02, 265.03
See application file for complete search history.

(56) References Cited

U.S. PATENT DOCUMENTS

2007/0019999 A1 * 1/2007 Park ..... 399/302
2010/0232819 A1 * 9/2010 Kudo et al. ..... 399/66

FOREIGN PATENT DOCUMENTS

JP 2006-064777 A 3/2006
JP 2009122389 A * 6/2009

* cited by examiner

*Primary Examiner* — David Gray
*Assistant Examiner* — Thomas Giampaolo, II
(74) *Attorney, Agent, or Firm* — Sughrue Mion, PLLC

(57) ABSTRACT

An image forming apparatus includes a transfer member onto a front side of which an image is transferred, a rotary member around which the transfer member is wrapped, a guide member provided at an end portion of an axial direction of the rotary member, a regulating member, a first reference mark, a second reference mark, a first detector, a second detector, and a controller. The regulating member is located on a reverse side of the transfer member, and restricts skew of the transfer member by contacting the guide member. The first and second reference marks are on edge sides of the transfer member in the axial direction of the rotary member. The first and second detectors detect the first and second reference marks, respectively. The controller controls alignment of the image on the transfer member in accordance with a detection result of the first and second detectors.

7 Claims, 11 Drawing Sheets

RELATED ART

RELATED ART

IMAGE FORMING APPARATUS AND COMPUTER READABLE MEDIUM STORING PROGRAM

CROSS-REFERENCE TO RELATED APPLICATIONS

This application is based on and claims priority under 35 USC 119 from Japanese Patent Application No. 2010-248725 filed Nov. 5, 2010.

BACKGROUND (i) Technical Field

The present invention relates to an image forming apparatus and a computer readable medium storing a program.

(ii) Related Art

Image forming apparatuses for electrophotographically forming an image, such as copiers and printers, have been available which are configured to transfer (first-transfer) a toner image formed on a photoconductor onto an intermediate transfer body and then transfer again (second-transfer) the toner image onto a recording medium such as printing paper, thereby forming an image on the recording medium.

Examples of a full-color image forming method in a configuration including an intermediate transfer body include the so-called four-cycle method in which toner images of respective color components such as yellow (Y), magenta (M), cyan (C), and black (K) components corresponding to the same full-color image are sequentially formed using a single image forming unit and in which the toner images of the respective color components are sequentially first-transferred onto the intermediate transfer body so that the toner images of the respective color components overlap one another on the intermediate transfer body.

The four-cycle image forming apparatuses have features in that, for example, the first transfer of toner images onto the intermediate transfer body is not affected by the material of the recording medium, and may therefore be suitable for the increased image quality of a full-color image to be formed.

In the formation of a full-color image using a four-cycle image forming apparatus, a reference mark (such as a reflective seal) on one end portion in the axial direction of a transfer belt serving as an intermediate transfer body is detected using a non-contact photosensor, and the detection of the reference mark may trigger start of writing in the image processing, leading to alignment of pixels between colors in the sub-scanning direction. This process is also known as the registration control.

Here, high-accuracy detection may be based on the stable attitude of the reference mark and the stable operating distance of the photosensor.

SUMMARY

According to an aspect of the invention, there is provided an image forming apparatus including a transfer member, a rotary member, a guide member, a regulating member, a first reference mark, a second reference mark, a first detector, a second detector, and a controller. The transfer member is configured to be circularly movable, and an image is transferred onto a front side of the transfer member. The transfer member is wrapped around a rotary member. The guide member is provided at an end portion of an axial direction of the rotary member. The regulating member is located on a reverse side of the transfer member in the end portion of the axial direction of the rotary member. The regulating member restricts skew of the transfer member by contacting the guide member. The first reference mark is provided in a first position on an edge side of the transfer member in the axial direction of the rotary member. The second reference mark is provided in a second position on another edge side of the transfer member in the axial direction of the rotary member. The first detector detects the first reference mark. The second detector detects the second reference mark. The controller controls alignment of the image on the transfer member in accordance with a detection result of the first detector and the second detector. The first position of the first reference mark and the second position of the second reference mark are located so that when the regulating member and the guide member are in contact with each other, only one of the first detector and the second detector detects the first reference mark or the second reference mark and so that when the regulating member and the guide member are not in contact with each other, both the first detector and the second detector detect the first reference mark and the second reference mark, respectively.

BRIEF DESCRIPTION OF THE DRAWINGS

Exemplary embodiment(s) of the present invention will be described in detail based on the following figures, wherein.

DETAILED DESCRIPTION

Figure 1:
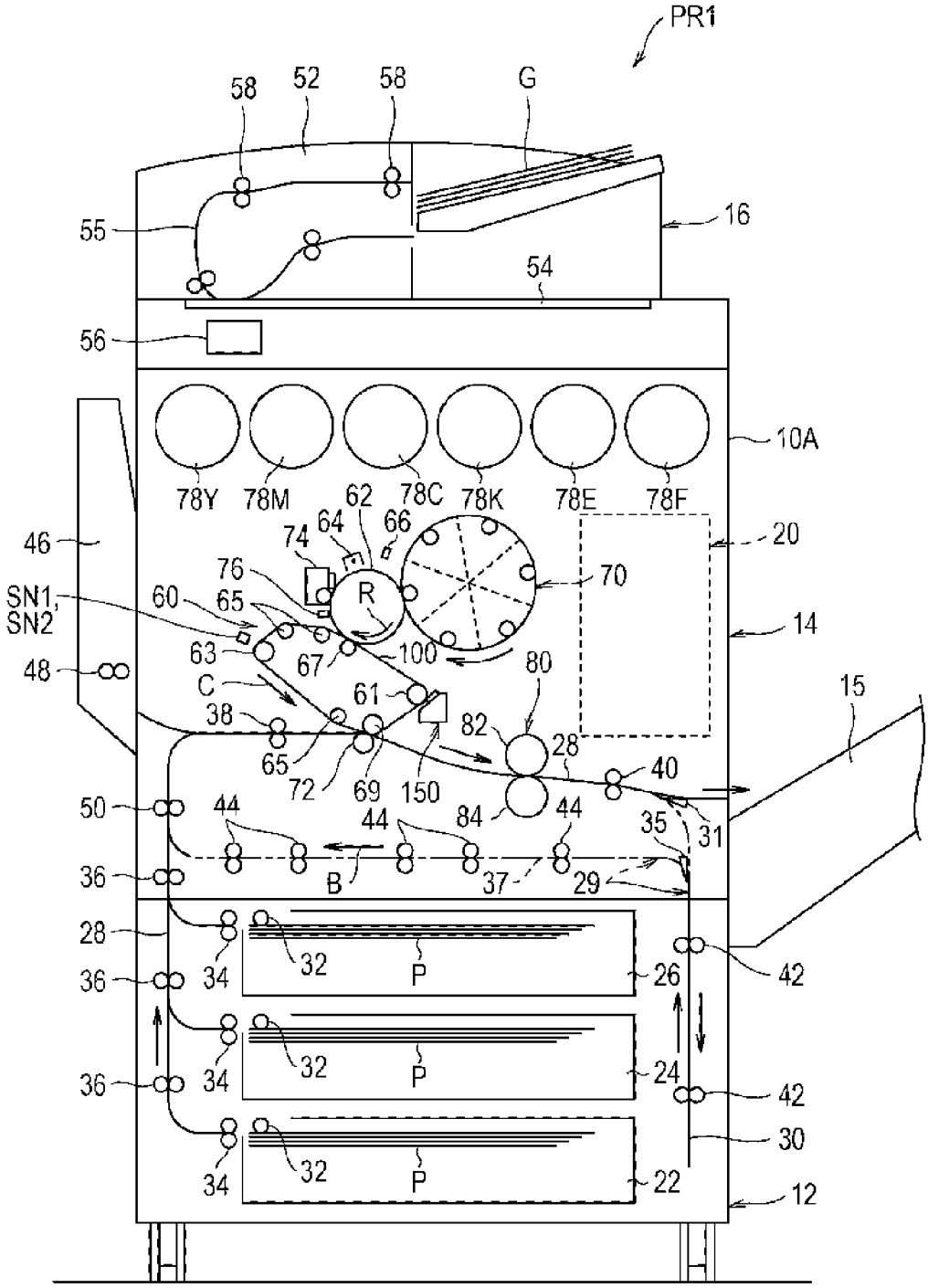
FIG. 1 illustrates the overall configuration of an image forming apparatus according to an exemplary embodiment.

An exemplary embodiment of the present invention will be described in detail hereinafter with reference to the drawings. In the drawings, the same or similar members are assigned the same numerals, and redundant description will be omitted. It is to be understood that the following exemplary embodiment is merely an example of the present invention and the present invention is not limited to the exemplary embodiment.

Before describing an image forming apparatus according to an exemplary embodiment of the present invention, an image forming apparatus according to a comparative example will be described with reference to FIGS. 10A, 10B, 11A, and 11B.

Generally, in the formation of a full-color image using a four-cycle image forming apparatus, a reference mark 200, such as a reflective seal, which is placed on an end portion in the axial direction of a transfer belt 100 serving as an intermediate transfer body is detected by a non-contact photosensor (not illustrated), and the detection of the reference mark 200 may trigger start of writing in the image processing, leading to alignment of pixels between colors in the sub-scanning direction. High-accuracy detection may be based on the stable attitude of the reference mark 200 and the stable operating distance of the photosensor.

Figure 10A:
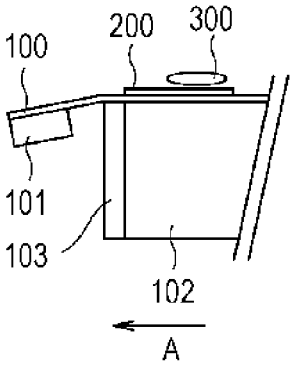
FIGS. 10A and 10B illustrate the configuration of a substantial part of an image forming apparatus according to a comparative example.
Figure 10B:
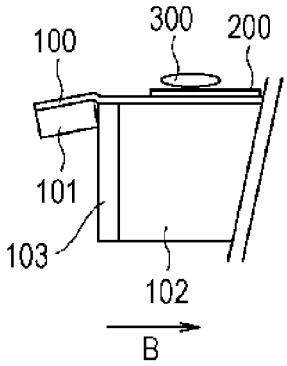
RELATED ART FIG. 10B

The image forming apparatus according to the comparative example illustrated in FIGS. 10A and 10B is configured such that a portion of the transfer belt 100 on which the reference mark 200 is formed is supported from the rear surface thereof by a roller 102 to improve the detection accuracy.

In FIGS. 10A to 11B, a rib (regulating member) 101 is provided on the inner side of each of both ends in the axial direction of the transfer belt 100, and is brought into contact with a rib guide 103 provided in an end portion of the roller 102 to regulate skew of the transfer belt 100. A region 300 is a photosensor detection region.

FIG. 10A illustrates the transfer belt 100 skewed to the side indicated by the arrow A, and FIG. 10B illustrates the transfer belt 100 skewed to the side indicated by the arrow B.

As illustrated in FIGS. 10A and 10B, the configuration of the image forming apparatus according to the comparative example allows the reference mark 200 to be located in the photosensor detection region 300 regardless of whether the transfer belt 100 is skewed in the direction indicated by the arrow A or B, leading to the stable attitude of the reference mark 200 and the stable operating distance of the photosensor. Therefore, detection accuracy may be improved.

In the above configuration, however, it may be necessary that the length of the roller 102 be greater than or equal to the value given by the sum of the "width of an image to be formed", the "length in the axial direction of the reference mark 200", and the "amount by which the transfer belt 100 has moved in the axial direction thereof due to skew" because the portion of the transfer belt 100 having the reference mark 200 is supported from the rear surface thereof by the roller 102. The size of the image forming apparatus itself may also be increased accordingly.

Figure 11A:
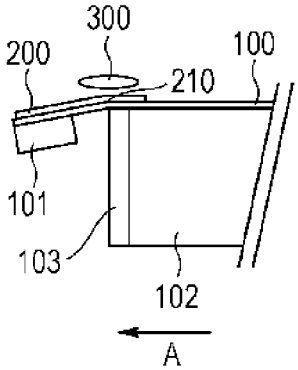
FIGS. 11A and 11B illustrate the configuration of a substantial part of an image forming apparatus according to another comparative example.
Figure 11B:
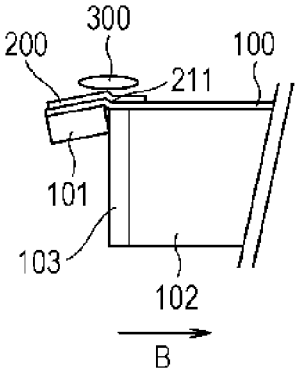
RELATED ART FIG. 11B

In an image forming apparatus according to another comparative example illustrated in FIGS. 11A and 11B, in contrast, a reference mark 200 is formed on the transfer belt 100 outside the axial length of the roller 102.

The above configuration may prevent the increase in the size of the image forming apparatus itself, but may cause variations in detection rate due to the deformation of an end portion of the transfer belt 100.

More specifically, as illustrated in FIG. 11A, a deformed portion 210 of the reference mark 200 may be formed when the transfer belt 100 is skewed to the side indicated by the arrow A, or, as illustrated in FIG. 11B, a deformed portion 211 of the reference mark 200 may be formed when the transfer belt 100 is skewed to the side indicated by the arrow B. In this case, a portion of light to be incident on the photosensor is diffusely reflected on the deformed portion 210 or 211, and the amount of light incident on the photosensor may change.

Such a change in the amount of light incident on the photosensor may cause difficulties such as image misalignment (or misregistration).

As a result of intensive studies to address the foregoing difficulties, the present inventors have achieved an image forming apparatus according to an exemplary embodiment of the present invention.

An image forming apparatus PR1 according to an exemplary embodiment of the present invention will be described with reference to FIGS. 1 to 9D.

FIG. 1 illustrates an overall configuration of the image forming apparatus PR1 according to this exemplary embodiment. The image forming apparatus PR1 includes a paper receiving unit 12 in which recording paper P is received so as to be stacked from bottom to top in the vertical direction as viewed in FIG. 1, and an image forming unit 14 provided above the paper receiving unit 12 and configured to form an image on recording paper P supplied from the paper receiving unit 12. The image forming apparatus PR1 further includes a document reading unit 16 provided above the image forming unit 14 and configured to read a document G, and a controller 20 provided in the image forming unit 14 and configured to control the operation of the individual units of the image forming apparatus PR1.

The paper receiving unit 12 includes a first receiving unit 22, a second receiving unit 24, and a third receiving unit 26. Sheets of recording paper P having different sizes are received in the first receiving unit 22, the second receiving unit 24, and the third receiving unit 26.

Each of the first receiving unit 22, the second receiving unit 24, and the third receiving unit 26 has a feed roller 32 configured to feed a sheet of recording paper P received therein to a transport path 28 in the image forming apparatus PR1.

Transport roller pairs 34 and 36 are provided in a portion of the transport path 28 downstream the feed rollers 32 to transport the recording paper P sheet by sheet.

Further, a transport roller pair 50 is provided downstream the transport roller pair 36 of the third receiving unit 26 so that the recording paper P fed from a reverse transport path 29 described below is transported along the transport path 28 that the reverse transport path 29 joins.

A registration roller pair 38 is provided downstream the transport roller pair 50 to temporarily stop the transport of the recording paper P and then feed the recording paper P to a second transfer position described below at a predetermined timing.

The upstream portion of the transport path 28, including the transport roller pair 50, is formed as a linear path extending in the vertical direction as viewed in FIG. 1. The downstream portion of the transport path 28, including the registration roller pair 38, is formed as a substantially linear path extending from the left to right of the image forming unit 14, that is, extending to a paper discharge unit 15 provided on the right side surface of a body 10A of the image forming apparatus PR1. Further, the reverse transport path 29 along which the recording paper P is reversed and transported is provided below the downstream portion of the transport path 28, including the registration roller pair 38.

The reverse transport path 29 has a first guide member 31 that guides the recording paper P from the transport path 28 to the reverse transport path 29, and a reversing portion 30 provided linearly in the vertical direction, as viewed in FIG. 1, from a lower right portion of the image forming unit 14 to a lower right portion of the paper receiving unit 12. The reverse transport path 29 also has a second guide member 35 that guides the recording paper P, which has been transported to the reversing portion 30, from the reversing portion 30 to a transport portion 37 described below, and the transport portion 37 along which the recording paper P guided by the second guide member 35 is transported.

The downstream portion of the transport portion 37 is arranged to join the transport path 28 between the transport roller pair 36 of the third receiving unit 26 and the transport roller pair 50. The reversing portion 30 has plural transport roller pairs 42 in positions at predetermined intervals, and the transport portion 37 has plural transport roller pairs 44 in positions at predetermined intervals.

The first guide member 31 may be shaped into substantially a triangular prism, and the tip of the first guide member 31 is moved by a driving unit (not illustrated) to either the transport path 28 or the reverse transport path 29 to guide the recording paper P to the transport path 28 or to the reverse transport path 29.

The second guide member 35 may also be shaped into substantially a triangular prism, and the tip of the second guide member 35 is moved by a driving unit (not illustrated) to either the reversing portion 30 or the transport portion 37 to guide the recording paper P to the reversing portion 30 or to the transport portion 37.

Further, a foldable manual feed unit 46 is provided on the left side surface of the body 10A of the image forming apparatus PR1. Recording paper P supplied from the manual feed unit 46 is transported by the transport roller pair 48 to a portion of the transport path 28 which is located downstream the transport roller pair 50 and upstream the registration roller pair 38.

The document reading unit 16 includes a document transport device 52 that automatically transports documents G one by one, and a platen glass 54 disposed below the document transport device 52 so that one document G is placed on the platen glass 54. The document reading unit 16 further includes a document reading device 56 that reads a document G transported by the document transport device 52 or a document G placed on the platen glass 54.

The document transport device 52 has an automatic transport path 55 along which plural transport roller pairs 58 are arranged. A portion of the automatic transport path 55 is arranged so as to allow a document G to pass over the platen glass 54. The document reading device 56 is configured to read a document G transported by the document transport device 52 while being stationary in a left end portion of the platen glass 54 or is configured to read a document G placed on the platen glass 54 while moving to the right.

The image forming unit 14 includes a cylindrical photoconductor 62 arranged substantially in the center of the body 10A of the image forming apparatus PR1 in such a manner that the axial direction of the photoconductor 62 extends from front to back of the body 10A.

The photoconductor 62 is driven by a driving unit (not illustrated) to rotate in the direction indicated by the arrow R (clockwise in FIG. 1), and is configured to hold an electrostatic latent image that is formed under irradiation with light. A corotron charging member 64 is provided at a position above the photoconductor 62 so as to face the surface (outer circumferential surface) of the photoconductor 62 to charge the surface of the photoconductor 62.

An exposure device 66 is provided at a position downstream the charging member 64 in the rotational direction of the photoconductor 62 so as to face the surface of the photoconductor 62. The exposure device 66 includes light emitting diodes (LEDs), and is configured to irradiate (or expose) the surface of the photoconductor 62 charged by the charging member 64 with (or to) light based on image signals corresponding to the respective toner colors to form an electrostatic latent image.

The exposure method used for the exposure device 66 is not limited to the LED method, and may be, for example, a laser scanning method in which laser light is scanned by a polygon mirror. A developing device 70 that is rotationally switchable is provided downstream the portion irradiated with light by the exposure device 66 in the rotational direction of the photoconductor 62 to develop the electrostatic latent image formed on the surface of the photoconductor 62 with the toners of the predetermined respective colors for visualization.

The developing device 70 has developing units (not illustrated in FIG. 1) corresponding to the respective toner colors of yellow (Y), magenta (M), cyan (C), black (K), a first special color (E), and a second special color (F). The developing units are arranged side by side along the circumference of the developing device 70, and are switched each time the developing device 70 is rotated 60° at the center angle using a motor (not illustrated in FIG. 1), which may serve as a rotary drive source, to face the surface of the photoconductor 62.

The first special color (E) and the second special color (F) may be colors selected from special colors (including transparent) other than, for example, yellow (Y), magenta (M), cyan (C), and black (K). When the first special color (E) and the second special color (F) are used, an image is formed in six colors, i.e., Y, M, C, K, E, and F.

Alternatively, an image may be formed in five colors, that is, the four, Y, M, C, and K colors and the first special color (E) or the second special color (F), or may be formed in four colors without using the first special color (E) or the second special color (F).

An intermediate transfer unit 60 as an example of a transfer device onto which a toner image formed on the surface of the photoconductor 62 is first-transferred is provided downstream the developing device 70 in the rotational direction of the photoconductor 62 and below the photoconductor 62.

The intermediate transfer unit 60 has an endless transfer belt 100 (intermediate transfer belt: an example of a transfer member) as an example of an image bearing member that circularly moves in the direction indicated by the arrow C (counterclockwise in FIG. 1).

The transfer belt 100 is wrapped around a driving roller 61 driven by the controller 20 to rotate, a tension applying roller 63 configured to apply tension to the transfer belt 100, plural transport rollers (tension applying rollers) 65 that are brought into contact with the rear surface (inner circumferential surface) of the transfer belt 100 and that rotate accordingly, and an auxiliary roller 69 that is brought into with the rear surface of the transfer belt 100 at a second transfer position described below and that rotates accordingly.

A first-transfer roller 67 is provided on the side of the transfer belt 100 opposite the side on which the photoconductor 62 is provided to first-transfer a toner image formed on the surface of the photoconductor 62 onto the front side surface (outer circumferential surface) of the transfer belt 100.

The first-transfer roller 67 comes into contact with the reverse side surface of the transfer belt 100 at the position spaced apart downstream in the movement direction of the transfer belt 100 from the position at which the photoconductor 62 and the transfer belt 100 are in contact with each other. The first-transfer roller 67 receives electric power from a power supply (not illustrated), and a potential difference is generated between the first-transfer roller 67 and the photoconductor 62 that is grounded. Thus, a toner image on the photoconductor 62 is first-transferred onto the surface of the transfer belt 100.

A cleaning blade 74 is provided downstream the first-transfer roller 67 in the rotational direction of the photoconductor 62 to remove residual toner and the like remaining on the surface of the photoconductor 62 without being first-transferred onto the surface of the transfer belt 100.

A first reference mark and a second reference mark (which are not illustrated in FIG. 1), each of which may be formed of a reflective seal or the like, serving as a reference for image alignment, are provided in end portions of the transfer belt 100, and a first photosensor SN1 and a second photosensor SN2 are provided so as to face the positions through which the first reference mark and a second reference mark pass.

As illustrated in FIG. 1, furthermore, a fixing device 80 is provided downstream the second transfer position to fix the toner images, which have been transferred onto recording paper P by a second-transfer roller 72, onto the recording paper P. The fixing device 80 includes a heat source that emits heat radiation by receiving electric power, a heating roller 82 arranged on the toner image side (or the upper side) of the recording paper P, and a pressing roller 84 arranged below the heating roller 82 and configured to press the recording paper P toward the outer circumferential surface of the heating roller 82.

A transport roller pair 40 is provided downstream the fixing device 80 to transport the recording paper P toward the paper discharge unit 15 or the reversing portion 30. Further, toner cartridges 78Y, 78M, 78C, 78K, 78E, and 78F in which the toners of yellow (Y), magenta (M), cyan (C), black (K), the first special color (E), and the second special color (F) are received respectively in a replaceable manner are provided side by side in the horizontal direction below the document reading device 56 and above the developing device 70.

The image forming apparatus PR1 further includes a cleaning blade 150 as an example of a cleaning device that removes and collects the residual toner remaining on the surface of the transfer belt 100 without being transferred onto the recording paper P after the second transfer.

Next, the configuration of a substantial part of the image forming apparatus PR1 according to this exemplary embodiment will be described with reference to FIGS. 2 and 3.

Figure 2:
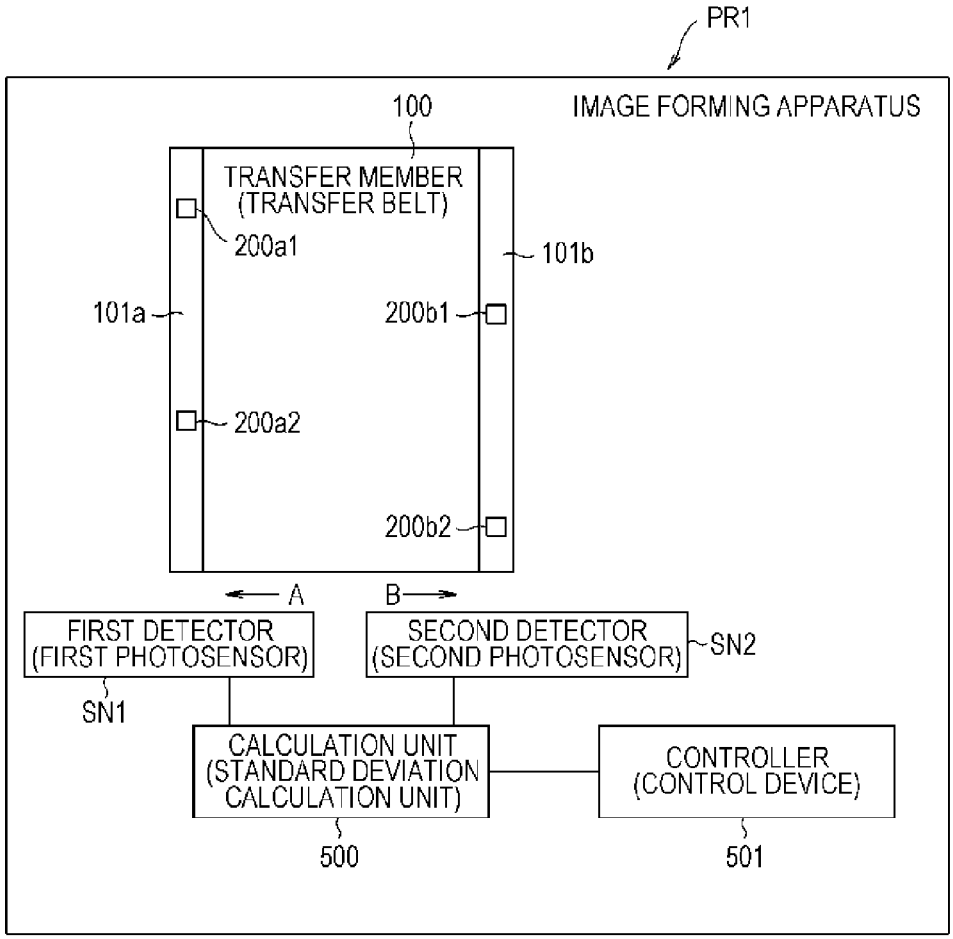
FIG. 2 is a block diagram illustrating the configuration of a substantial part of the image forming apparatus according to the exemplary embodiment.
Figure 3:
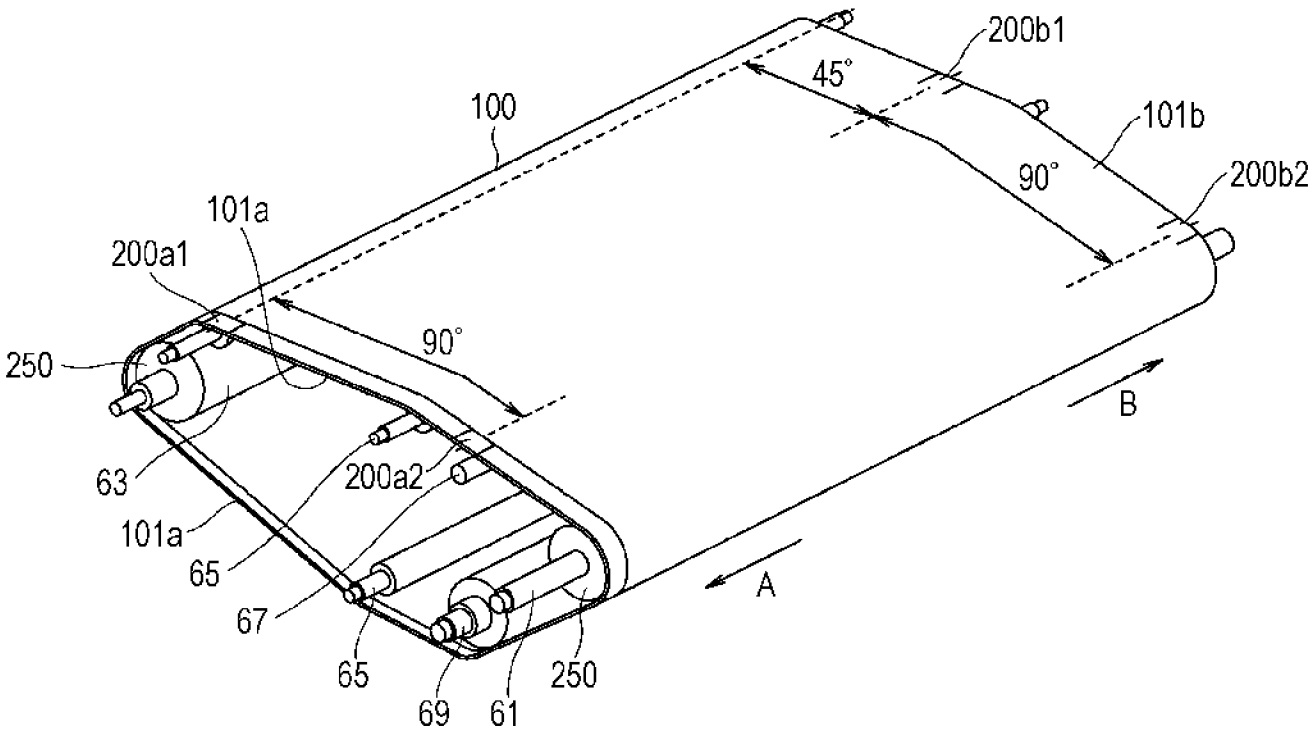
FIG. 3 is a perspective view illustrating the configuration of the substantial part of the image forming apparatus according to the exemplary embodiment.

As illustrated in FIGS. 2 and 3, the substantial part of the image forming apparatus PR1 according to this exemplary embodiment includes a band-shaped transfer belt 100 (an example of a transfer member) onto which an image is transferred and which may be formed of polyimide or the like. The transfer belt 100 is configured to be circularly movable. The substantial part of the image forming apparatus PR1 further includes metal rollers 61, 63, etc. (examples of a rotary member) around which the transfer belt 100 is wrapped, and ribs 101*a* and 101*b* (examples of a regulating member) that are provided on the reverse side of the transfer belt 100 at both end portions in the axial direction and that extend in the direction in which the transfer belt 100 circularly moves. The ribs 101*a* and 101*b* are brought into contact with resin rib guides 250 (examples of a guide member) provided in end portions of the rollers 61, 65, etc., and regulate skew of the transfer belt 100.

The ribs 101*a* and 101*b* may be composed of, for example but not limited to, urethane rubbers or the like with a width of 5 mm and a thickness of 1 mm.

Further, the transfer belt 100 has first reference marks (examples of a first reference mark) 200*a* (200*a*1, 200*a*2, . . . ) provided in preset positions on the outer side of one end portion thereof in the axial direction of the rotary members such as the rollers 61 and 63. The first reference marks 200*a* may be used as a reference for image alignment, and may be formed of a reflective seal or the like. The transfer belt 100 also has second reference marks (examples of a second reference mark) 200*b* (200*b*1, 200*b*2, . . . ) provided in preset positions on the outer side of the other end portion thereof in the axial direction. The second reference marks 200*b* may be used as a reference for image alignment, and may be formed of a reflective seal or the like.

The first reference marks 200*a* and the second reference marks 200*b* may be formed of, for example but not limited to, reflective tapes of 12 mm×12 mm.

Further, as illustrated in FIG. 3, in this exemplary embodiment, four first reference marks 200*a* and four second reference marks 200*b* may be provided at equal intervals of 90 degrees along the circumference of the transfer belt 100 which is maintained at a circular shape.

As illustrated in FIG. 3, furthermore, in this exemplary embodiment, the first reference marks 200*a*1, 200*a*2, 200*a*3, and 200*a*4 (only the first reference marks 200*a*1 and 200*a*2 are visible in FIGS. 2 and 3) and the second reference marks 200*b*1, 200*b*2, 200*b*3, and 200*b*4 (only the second reference marks 200*b*1 and 200*b*2 are visible in FIGS. 2 and 3) may have phases shifted by 45 degrees with respect to each other.

The phases may be shifted by any angle other than 45 degrees.

Therefore, the detection accuracy of the first reference marks 200*a* and the second reference marks 200*b* on the transfer belt 100, which is curly while the image forming apparatus PR1 is not operating, may be improved.

The image forming apparatus PR1 further includes a first photosensor SN1 (an example of a first detector) that detects reflected light from the first reference marks 200*a*, and a second photosensor SN2 (an example of a second detector) that detects reflected light from the second reference marks 200*b*.

Here, the first reference marks 200*a* and the second reference marks 200*b* may be provided in positions so that when the rib 101*a* or 101*b* is in contact with the rib guides 250 of the rollers 61, 65, etc. (that is, when the transfer belt 100 is skewed in the direction indicated by the arrow A or B), only one of the first photosensor SN1 and the second photosensor SN2 which is located on the side opposite the side on which skew has occurred detects the first reference marks 200*a* or the second reference marks 200*b* and so that when the rib 101*a* or 101*b* are not in contact with the rib guides 250 of the rollers 61, 65, etc. (that is, when the transfer belt 100 is not skewed), both the first photosensor SN1 and the second photosensor SN2 detect the first reference marks 200*a* and the second reference marks 200*b*, respectively.

In this exemplary embodiment, more specifically, the first reference marks 200*a* and the second reference marks 200*b* may be provided in positions so that when the transfer belt 100 is skewed in the direction indicated by the arrow A, only the second photosensor SN2 located on the side opposite the side indicated by the arrow A detects the second reference marks 200*b* while, when the transfer belt 100 is skewed in the direction indicated by the arrow B, only the first photosensor SN1 located on the side opposite the side indicated by the arrow B detects the first reference marks 200*a*, and so that when the transfer belt 100 is not skewed, the first photosensor SN1 detects the first reference marks 200*a* and the second photosensor SN2 detects the second reference marks 200*b*.

The first reference marks 200*a* and the second reference marks 200*b* may also be provided in positions that are located outside in the axial direction with respect to the detection region of the first photosensor SN1 or the second photosensor SN2 which is located on the side on which the transfer belt 100 is skewed when the rib 101*a* or 101*b* is in contact with end portions of the rollers 61, 65, etc. (that is, when the transfer belt 100 is skewed in the direction indicated by the arrow A or B).

As illustrated in FIG. 2, the image forming apparatus PR1 further includes a standard deviation calculation unit 500 (an example of a calculation unit), and a control device 501 (an example of a controller) that may be formed of a microcomputer or the like. The standard deviation calculation unit 500 calculates a standard deviation of displacement for each of the first photosensor SN1 and the second photosensor SN2 with respect to the average rotation cycle of the transfer belt 100. The average rotation cycle is a value according to the average time of one rotation of the transfer belt 100. It may be calculated by measuring the rotation time a predetermined number of times and averaging them (the rotation time is time for one rotation of the transfer member, or the transfer belt 100), such as moving average, or by averaging all records of rotation time recorded in the memory in the image forming apparatus. When both the first photosensor SN1 and the second photosensor SN2 detect the first reference marks 200*a* and the second reference marks 200*b*, respectively, the control device 501 performs image alignment control on the transfer belt 100 based on the calculation result of the standard deviation calculation unit 500, in accordance with the detection result of the first photosensor SN1 or the second photosensor SN2 for which the standard deviation is smaller.

In this exemplary embodiment, when only one of the first photosensor SN1 and the second photosensor SN2 detects the first reference marks 200*a* or the second reference marks 200*b*, the control device 501 performs image alignment control in accordance with the detection result of the first photosensor SN1 or the second photosensor SN2 which has performed detection.

The image forming apparatus PR1 having the above configuration according to this exemplary embodiment may improve the detection accuracy of the first reference marks 200*a* and the second reference marks 200*b* without increasing the size of the image forming apparatus PR1 compared to the image forming apparatuses according to the comparative examples described above.

Next, the relationship between the presence or absence of skew of the transfer belt 100 and the detection of the first reference marks 200*a* or the second reference marks 200*b* according to this exemplary embodiment will be described with reference to FIGS. 4A to 6C.

Figure 4A:
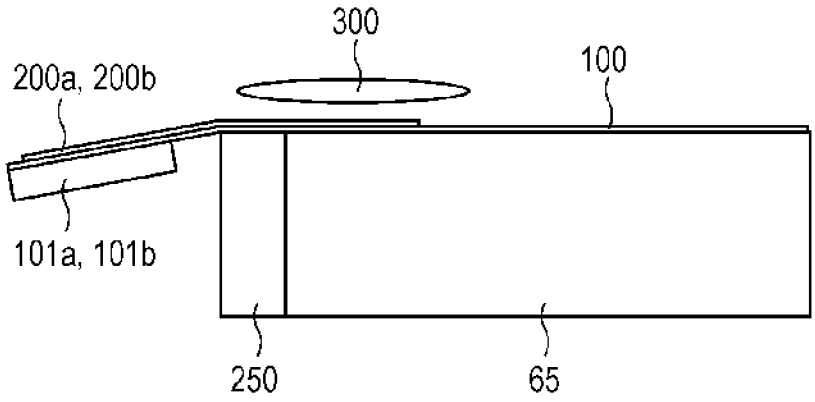
FIGS. 4A to 4C illustrate the relationship between the presence or absence of skew of a transfer belt and the detection of a first reference mark or a second reference mark.

FIG. 4A illustrates a state where the rib 101*a* or 101*b* are not in contact with the rib guides 250 of the rollers 65, etc. (that is, a state where the transfer belt 100 is not skewed).

In the illustrated example, the first reference marks 200*a* and the second reference marks 200*b* may have a size of, for example but not limited to, 12 mm×12 mm, and the first photosensor SN1 and the second photosensor SN2 may have a detection region (sensor spot) 300 of a diameter of, for example but not limited to, 7 mm. The roller 65 may have a diameter of, for example but not limited to, 33.6 mm, and the rib guide 250 may have a width of, for example but not limited to, 2 mm.

Figure 4B:
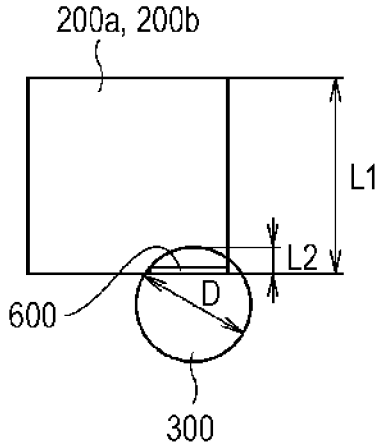

In the above state, the diameter D of the detection region 300, the length L1 of the first reference marks 200*a* or the second reference marks 200*b* in the sub-scanning direction, a minimum region 600 of reflected light that is to be detected, and the distance L2 in the sub-scanning direction which is required until the minimum region 600 has been detected have a relationship as illustrated in FIG. 4B.

Figure 4C:
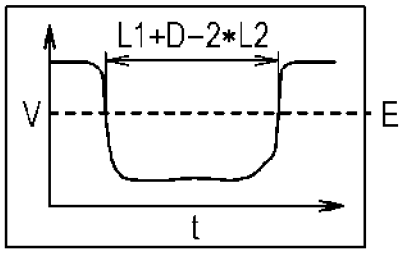

FIG. 4C illustrates the output waveform of the first photosensor SN1 and the second photosensor SN2 (the ordinate representing voltage V and the abscissa representing time t) in this case.

In this case, furthermore, the time during which the voltage is lower than a binary threshold E is given by L1+D−2×L2. Therefore, a sufficient detection output may be obtained and high-accuracy color alignment based on the detection result of the first photosensor SN1 or the second photosensor SN2 may be achieved.

A specific process for selecting either the first photosensor SN1 or the second photosensor SN2 will be described below.

Figure 5A:
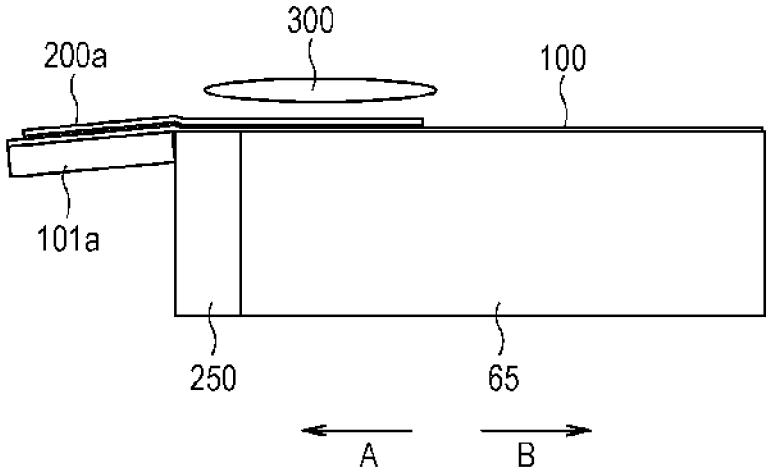
FIGS. 5A to 5C illustrate the relationship between the presence or absence of skew of the transfer belt and the detection of the first reference mark or the second reference mark.

FIG. 5A illustrates the state on the first reference marks 200*a* side in a state where the rib 101*a* is in contact with the rib guides 250 of the rollers 65, etc. (that is, in a state where the transfer belt 100 is skewed in the direction indicated by the arrow B).

Figure 5B:
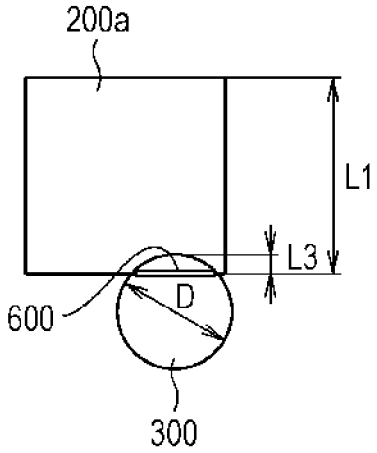

In this state, the diameter D of the detection region 300, the length L1 of the first reference marks 200*a* in the sub-scanning direction, the minimum region 600 of reflected light that is to be detected, and the distance L3 in the sub-scanning direction which is required until the minimum region 600 has been detected have a relationship as illustrated in FIG. 5B.

Figure 5C:
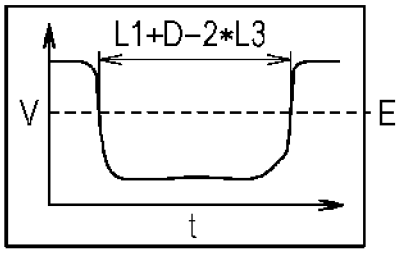

FIG. 5C illustrates the output waveform of the first photosensor SN1 (the ordinate representing voltage V and the abscissa representing time t) in this case.

In this case, furthermore, the time during which the voltage is lower than a binary threshold E is given by L1+D−2×L3. Therefore, a sufficient detection output may be obtained.

Figure 6A:
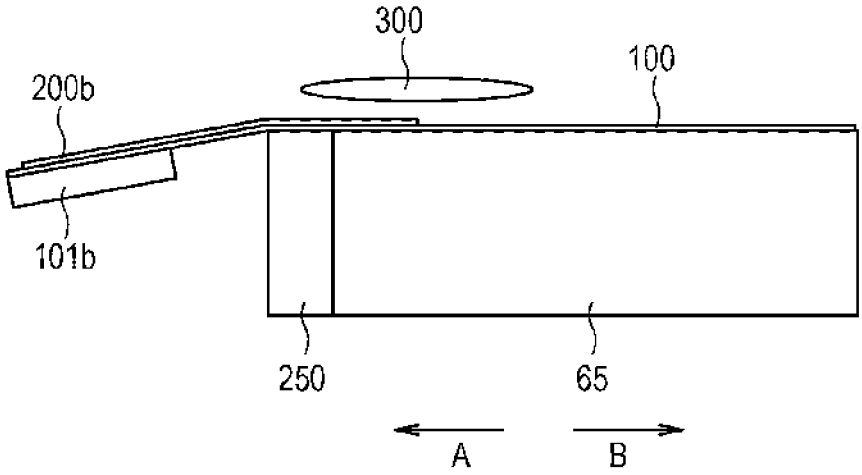
FIGS. 6A to 6C illustrate the relationship between the presence of skew (skewing) of the transfer belt and the detection state of the first reference mark or the second reference mark.

In contrast, FIG. 6A illustrates the state on the second reference marks 200*b* side in a state where, as illustrated in FIG. 5A, the rib 101*a* is in contact with the rib guides 250 of the rollers 65, etc. (that is, in a state where the transfer belt 100 is skewed in the direction indicated by the arrow A).

Figure 6B:
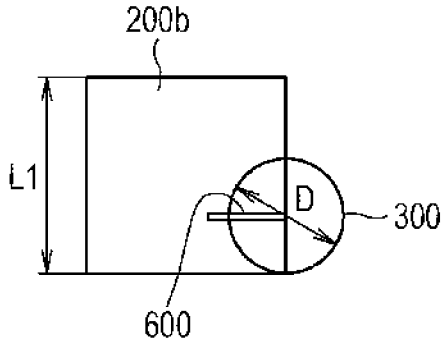

In this state, the diameter D of the detection region 300, the length L1 of the second reference marks 200*b* in the sub-scanning direction, the minimum region 600 of reflected light that is to be detected, and the distance L3 in the sub-scanning direction which is required until the minimum region 600 has been detected (in this case, the minimum region 600 is undetectable, and the distance L3 is not illustrated in FIG. 6B) have a relationship as illustrated in FIG. 6B.

Figure 6C:
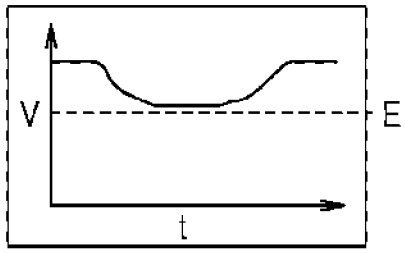

FIG. 6C illustrates the output waveform of the second photosensor SN2 (the ordinate representing voltage V and the abscissa representing time t) in this case. Since no region lower than the binary threshold E exists, the second reference marks 200*b* are not detected by the second photosensor SN2.

Therefore, in the cases illustrated in FIGS. 5A to 5C and 6A to 6C, high-accuracy color alignment may be performed based on the detection result of the first photosensor SN1.

When the rib 101*b* comes into contact with the rib guides 250 of the rollers 65, etc. (that is, when the transfer belt 100 is skewed in the direction indicated by the arrow A), the second photosensor SN2 exhibits an output waveform as illustrated in FIG. 5C while the first photosensor SN1 exhibits an output waveform as illustrated in FIG. 6C.

In this case, high-accuracy color alignment may be performed based on the detection result of the second photosensor SN2.

Figure 7:
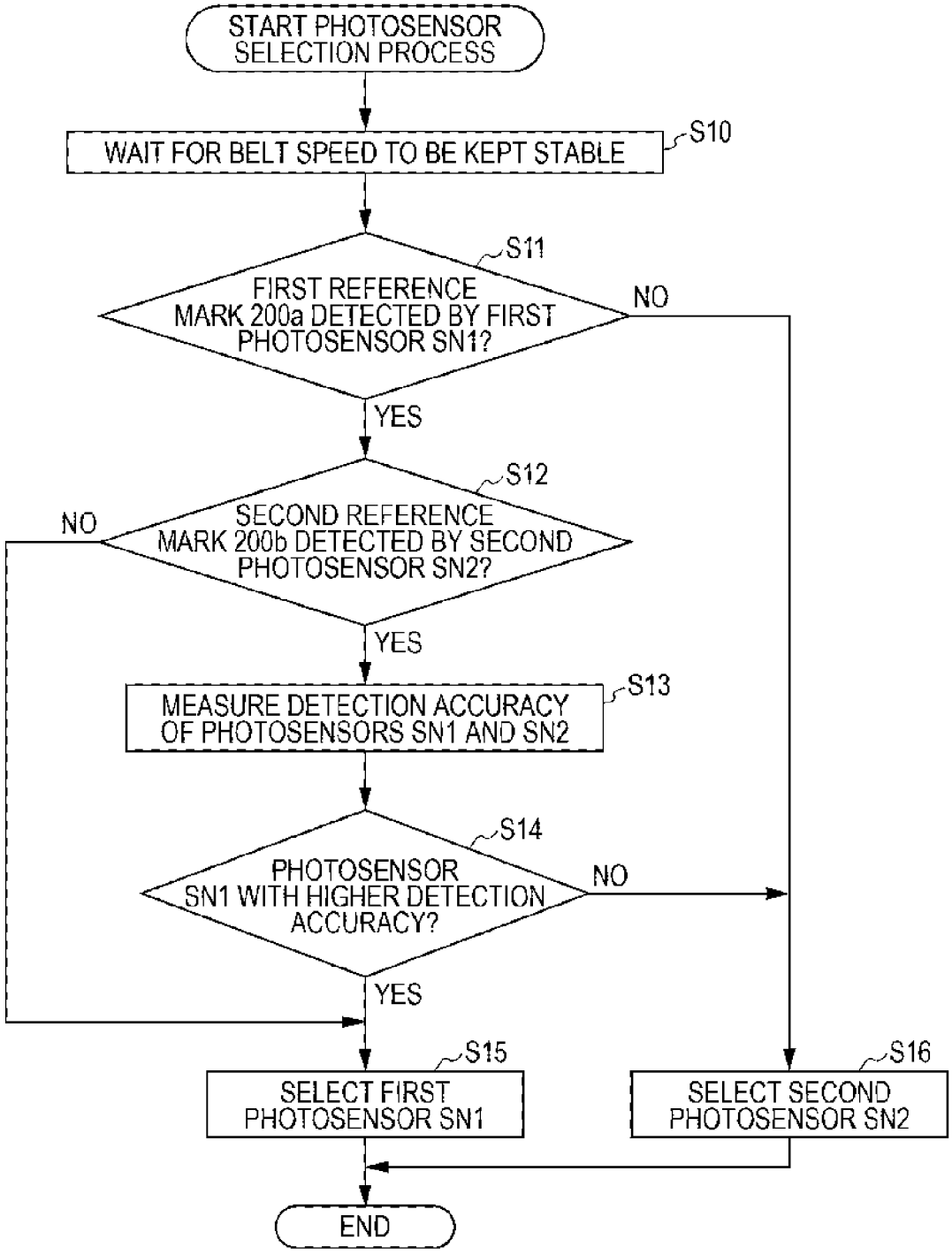
FIG. 7 is a flowchart illustrating a processing procedure of a photosensor selection process.

Next, a processing procedure of a photosensor selection process executed by the image forming apparatus PR1 according to this exemplary embodiment will be described with reference to a flowchart of FIG. 7.

When the process is started, first, in step S10, the process waits for the speed of the transfer belt 100 to be kept stable at a preset value. When the speed of the transfer belt 100 is kept stable, the process proceeds to step S11.

In step S11, it is determined whether or not the first photosensor SN1 has detected a first reference mark 200*a*. If "NO" is determined, the process proceeds to step S16, in which the second photosensor SN2 is selected for image alignment. Then, the process ends.

If "YES" is determined in step S11, the process proceeds to step S12, in which it is determined whether or not the second photosensor SN2 has detected a second reference mark 200*b*.

If "NO" is determined in step S12, the process proceeds to step S15, in which the first photosensor SN1 is selected for image alignment. Then, the process ends.

If "YES" is determined in step S12, the process proceeds to step S13, in which the detection accuracy of the first photosensor SN1 and the detection accuracy of the second photosensor SN2 are measured.

Specifically, the standard deviation calculation unit 500 calculates a standard deviation of displacement for each of the first photosensor SN1 and the second photosensor SN2 with respect to the average rotation cycle of the transfer belt 100.

Then, in step S14, it is determined, based on the calculated standard deviation of displacement, whether or not the detection accuracy of the first photosensor SN1 is higher. If "NO" is determined, the process proceeds to step S16, in which the second photosensor SN2 is selected for image alignment. Then, the process ends.

If "YES" is determined in step S14, the process proceeds to step S15, in which the first photosensor SN1 is selected for image alignment. Then, the process ends.

FIGS. 8A to 8D illustrate an example of color misregistration (or misalignment) when this exemplary embodiment is used, and FIGS. 9A to 9D illustrate an example of color misregistration (or misalignment) when this exemplary embodiment is not used.

Figure 8A:
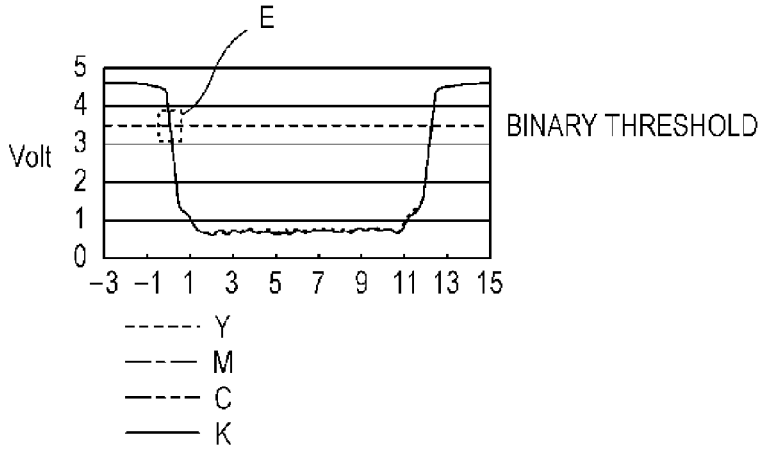
FIGS. 8A to 8D are graphs illustrating color misregistration when this exemplary embodiment is used.
Figure 8B:
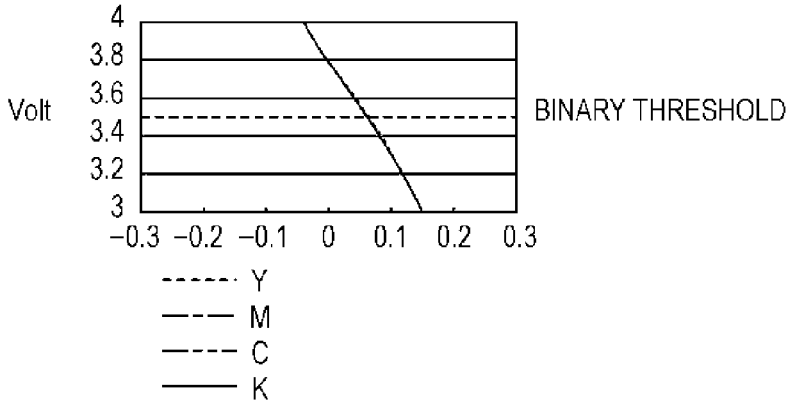
Figure 8C:
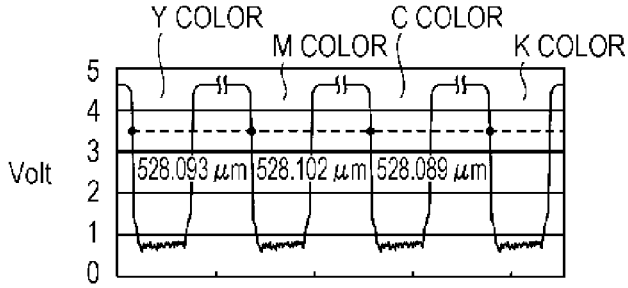
Figure 8D:
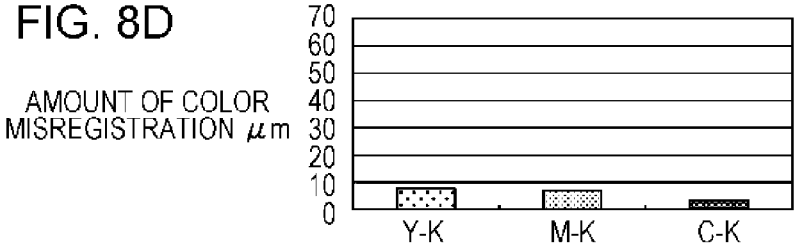

As illustrated in FIGS. 8B and 8C, according to this exemplary embodiment, the amount of color misregistration of the four YMCK colors is comparatively small. In addition, as illustrated in FIG. 8D, the amount of color misregistration between the Y and K colors (Y-K), the M and K colors (M-K), and the C and K colors (C-K) is reduced to 10 μm or less.

Figure 9A:
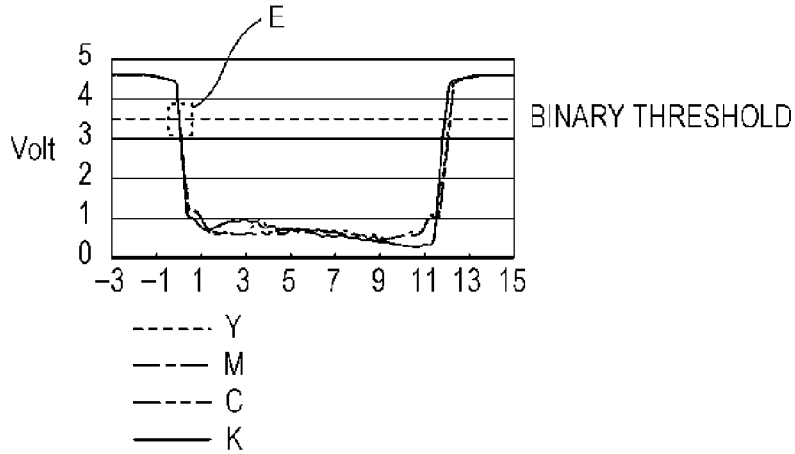
FIGS. 9A to 9D are graphs illustrating color misregistration when this exemplary embodiment is not used.
Figure 9B:
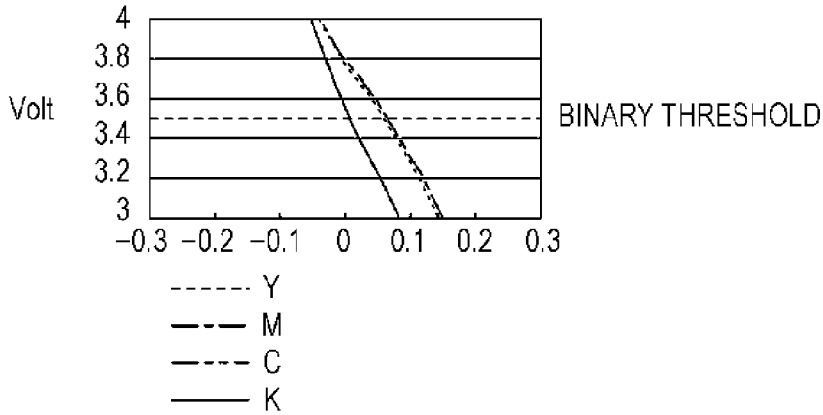
Figure 9C:
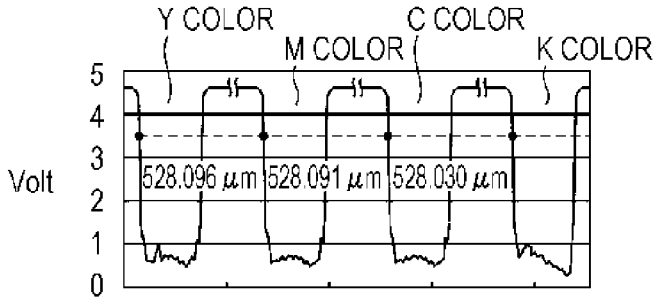
Figure 9D:
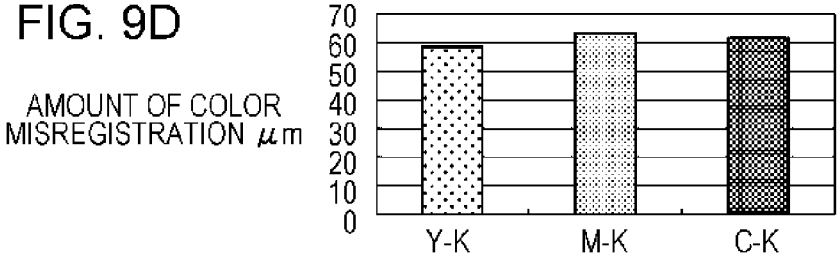

In contrast, as illustrated in FIGS. 9B and 9C, when this exemplary embodiment is not used, the amount of color misregistration of the four YMCK colors is comparatively large. In addition, as illustrated in FIG. 9D, the amount of color misregistration between the Y and K colors (Y-K), the M and K colors (M-K), and the C and K colors (C-K) is approximately 60 μm.

Accordingly, the image forming apparatus PR1 according to this exemplary embodiment may reduce color misregistration without increasing the size of the image forming apparatus PR1 itself.

While an exemplary embodiment of the invention made by the present inventors has been described in detail, the exemplary embodiment disclosed herein is merely an example, and is not intended to limit the scope of the techniques disclosed herein. The technical scope of the present invention should not be construed restrictively on the basis of the exemplary embodiment described above. In other words, the present invention should be construed in accordance with the appended claims. Techniques equivalent to the techniques described in the claims and all the changes that may be made in the claims fall within the scope of the invention.

Furthermore, a program may be provided via a network, or may be provided by being stored in a recording medium such as a compact disc read only memory (CD-ROM).

That is, a certain program including an image processing program may be recorded on a storage device such as a hard disk serving as a recording medium, and may also be provided in the following manner.

For example, the certain program may be stored in a ROM, and a central processing unit (CPU) may load the certain program into a main memory from the ROM and may execute the program.

The certain program may also be stored in a computer-readable recording medium such as a digital versatile disc read-only memory (DVD-ROM), a CD-ROM, a magneto-optical (MO) disk, or a flexible disk, and may be distributed.

Furthermore, an image forming apparatus or the like connected to a server device or a host computer via a communication line (for example, the Internet) may download the certain program described above from the server device or the host computer, and may execute the certain program. In this case, the certain program may be downloaded to a memory such as a random access memory (RAM) or a storage device (or recording medium) such as a hard disk.

An image forming apparatus and a processing program according to exemplary embodiments of the present invention may be applied to printers, multifunction devices, and other suitable devices.

What is claimed is:

1. An image forming apparatus comprising:

a transfer member onto a front side of which an image is transferred, the transfer member being configured to be circularly movable;

a rotary member around which the transfer member is wrapped;

a guide member provided at an end portion of an axial direction of the rotary member;

a regulating member that is located on a reverse side of the transfer member in the end portion of the axial direction of the rotary member, the regulating member restricting skew of the transfer member by contacting the guide member;

a first reference mark provided in a first position on an edge side of the transfer member in the axial direction of the rotary member;

a second reference mark provided in a second position on another edge side of the transfer member in the axial direction of the rotary member;

a first detector that detects the first reference mark;

a second detector that detects the second reference mark; and a controller that controls alignment of the image on the transfer member in accordance with a detection result of the first detector and the second detector, wherein the first position of the first reference mark and the second position of the second reference mark are located so that when the regulating member and the guide member are in contact with each other, only one of the first detector and the second detector detects the first reference mark or the second reference mark and so that when the regulating member and the guide member are not in contact with each other, both the first detector and the second detector detect the first reference mark and the second reference mark, respectively.

2. The image forming apparatus according to claim 1, wherein the first reference mark and the second reference mark are provided so that one of the first reference mark and the second reference mark is located outside a detection region of the first detector or the second detector when the regulating member and the guide member are in contact with each other.

3. The image forming apparatus according to claim 2, wherein the first reference mark includes a plurality of first reference marks and the second reference mark includes a plurality of second reference marks, and wherein the plurality of first reference marks and the plurality of second reference marks are provided at equal intervals in the direction in which the transfer member circularly moves and are provided at different positions in the direction in which the transfer member circularly moves.

4. The image forming apparatus according to claim 1, wherein the first reference mark includes a plurality of first reference marks and the second reference mark includes a plurality of second reference marks, and wherein the plurality of first reference marks and the plurality of second reference marks are provided at equal intervals in the direction in which the transfer member circularly moves and are provided at different positions in the direction in which the transfer member circularly moves.

5. The image forming apparatus according to claim 1, further comprising a calculation unit that calculates a standard deviation of displacement for the first detector and a standard deviation of displacement for the second detector with respect to an average rotation cycle of the transfer member, wherein when both the first detector and the second detector are capable of detecting the first reference mark and the second reference mark, respectively, the controller controls alignment of the image based on a calculation result of the calculation unit, in accordance with a detection result of one of the first detector and the second detector for which the standard deviation is smaller.

6. The image forming apparatus according to claim 5, wherein when only one of the first detector and the second detector detects the first reference mark or the second reference mark, the controller controls alignment of the image in accordance with a detection result of the one of the first detector and the second detector that is capable of detecting the first reference mark or the second reference mark.

7. A non-transitory computer readable medium storing a program causing a computer to execute a process for performing processing, the process comprising:

calculating a standard deviation of displacement for a first detector and a standard deviation of displacement for a second detector with respect to an average rotation cycle of a transfer member;

when both the first detector and the second detector detects a first reference mark and a second reference mark, respectively, controlling alignment of an image on the transfer member based on the calculated standard deviations of displacement for the first detector and the second detector in accordance with a detection result of one of the first detector and the second detector for which the standard deviation is smaller; and when only one of the first detector and the second detector detects a first reference mark or a second reference mark, controlling alignment of an image on the transfer member in accordance with a detection result of the one of the first detector and the second detector that is capable of detecting the first reference mark or the second reference mark.

* * * * *